United States Patent [19]

Graute

[11] Patent Number: 5,007,137

[45] Date of Patent: Apr. 16, 1991

[54] CARDING APPARATUS

[75] Inventor: Horst Graute, Coesfeld, Fed. Rep. of Germany

[73] Assignee: Hergeth Hollingsworth GmbH, Dulmen, Fed. Rep. of Germany

[21] Appl. No.: 460,706

[22] Filed: Jan. 4, 1990

[30] Foreign Application Priority Data

Jan. 18, 1989 [DE] Fed. Rep. of Germany ..... 3901313

[51] Int. Cl.[5] ..... D01G 25/00; D01G 15/46

[52] U.S. Cl. ..... 19/296; 19/145.7; 19/304

[58] Field of Search ..... 19/144, 145.7, 296, 19/304, 305, 306

[56] References Cited

U.S. PATENT DOCUMENTS

| | | | |
|---|---|---|---|
| 2,825,389 | 3/1958 | Stephens | 19/304 |
| 2,913,365 | 11/1959 | Osborne et al. | 19/306 |
| 3,228,067 | 1/1966 | Strang et al. | 19/304 |
| 3,268,954 | 8/1966 | Joa | 19/306 |
| 3,606,175 | 9/1971 | Appel et al. | 19/306 |
| 3,768,119 | 10/1973 | Wood | 19/306 |
| 3,982,302 | 9/1976 | Vaalburg | 19/306 |
| 4,097,965 | 7/1978 | Gotchel et al. | 19/306 |
| 4,130,915 | 12/1978 | Gotchel et al. | 19/304 |
| 4,475,271 | 10/1984 | Lovgren et al. | 19/105 |
| 4,528,050 | 7/1985 | Arther et al. | 19/305 |
| 4,534,086 | 8/1985 | Fehrer | 19/99 |
| 4,615,080 | 10/1986 | Wirth | 19/106 R |
| 4,706,338 | 11/1987 | Anspach | 19/105 |
| 4,712,277 | 12/1987 | Gustavsson | 19/296 |

FOREIGN PATENT DOCUMENTS

| | | | |
|---|---|---|---|
| 93585 | 11/1983 | European Pat. Off. . | |
| 248149 | 7/1987 | Fed. Rep. of Germany | 19/304 |

*Primary Examiner*—Werner H. Schroeder
*Assistant Examiner*—Michael A. Neas
*Attorney, Agent, or Firm*—Bailey & Hardaway

[57] ABSTRACT

In a card especially suited for the manufacture of nonwovens for producing aerodynamically formed, air laid, fibrous webs, comprising a feed roller (F), a driven main cylinder (T) rotating at a high speed, an air shaft or passage (2) which, adjacent the fiber doffing zone (3) is substantially tangential to the main cylinder (T), and which extends to an air-permeable nonwovens web conveying belt (5), and a suction fan (11), arranged beneath the nonwovens conveying belt (5), the centrifugal force at the main cylinder (T) throwing the fibers in the fiber doffing zone (3) into the air current generated in the air shaft (2) and conveying the fibers to the nonwovens conveying belt (5) where they are depsosited as a continuous fibrous web, it is provided that the upper portion of the air shaft (2) is designed as an air suction gap having a substantially nozzle-shaped cross section.

29 Claims, 2 Drawing Sheets

CARDING APPARATUS

BACKGROUND OF THE INVENTION

The invention relates to a card especially suited for manufacturing nonwovens for the production of air laid fibrous webs formed aerodynamically, comprising fiber feed means, a driven main cylinder rotating at a high speed, an air shaft or passage which, within the area of the fiber doffing zone, extends substantially tangentially to the main cylinder and as far as to an air-permeable nonwovens web conveying means and suction means arranged beneath the nonwovens web conveying means, the centrifugal force at the main cylinder throwing the fibers in the fiber doffing zone into the air current generated in the air passage and adapted to transport the fibers to the nonwovens conveying means to deposit them as a fibrous web, and a process for the aerodynamic formation of a fibrous web comprising the following steps:

1. applying fibers to a driven cylinder rotating at a high speed;

2. throwing the opened fibers within the area of a fiber doffing zone from the cylinder into an air current; and 3. conveying the fibers into the air current to an air-permeable nonwovens conveying means and separating the fibers from the air current on the nonwovens conveying means.

Such nonwovens cards for the production of aerodynamically formed fibrous webs have been known for instance from U.S. Pat. No.(s). 4,064,600, 4,130,15 and EP-A-0 093,585.

In case of the nonwovens card disclosed in U.S. Pat. No. 4,097,965, compressed air is blown into the air shaft or air passage extending substantially tangentially to the main cylinder, said compressed air being rerouted within the range of the main cylinder by a deflecting plate to radially strike on the main cylinder. As a result thereof, upon their exit from the carding area, fibers are not detached directly from the main cylinder, but they are separated from the latter at a certain delay entailing a displacement of the fiber doffing zone. Air current used with said nonwovens card is sharply deviated repeatedly and air current homogeneity is affected accordingly. Above all, due to the deviation of the air current at the deflecting flap in a direction containing a component counter to the sense of rotation of the main cylinder, strong turbulences of the conveying air are caused which impair the uniformity of the fibrous web deposited on the nonwovens conveying means.

U.S. Pat. No. 4,130,915 relates to an improvement of the foregoing nonwovens card in which the air shaft extends only as far as to the main cylinder, said air shaft being provided, if necessary, with compressed air, while, in addition, a segment of the carding region, is exposed to a pressure between 150 and 400 mm Ws at an air current of $28m^3/(min.m)$.

EP-A-0 093,585 discloses a nonwovens card in which a turbulent air current is generated in an air shaft extending tangentially to the main cylinder, said air shaft hardly constricted cross-sectionally, comprising in the fiber doffing zone a sharp kink increasing the turbulence of the air current.

SUMMARY OF THE INVENTION

It is the object of the invention to provide a nonwovens card in which, for obtaining a high uniformity of the nonwovens, the aerodynamic nonwovens formation is improved also in case of high production rates and large machine widths.

The problem is solved according to the invention in that in the upper portion of the air shaft, there is provided an air suction gap having a substantially nozzle-shaped cross section.

Due to the nozzle-shaped configuration of the air suction gap provided in the upper portion of the air shaft, the absorbed air current is affected as little as possible. There is no abrupt change of the air current direction and turbulences as well as turbulent flow conditions in the air shaft are excluded accordingly.

Further, as a result of the aerodynamic shape of the air suction gap cross section, a laminar air flow without turbulences is ensured even at high flow rates so that individual fibers being separated from the main cylinder are circumcirculated by the highest possible amount of air without being able to mutually interhook or agglomerate with adjacent individual fibers on account of air turbulences on the exit path between main cylinder and nonwovens conveying means. The laminar air flow ensures a high uniformity of the nonwovens deposit which, for instance, is represented by an uncloudy web aspect. At the same time, it is possible to produce a nonwoven fabric having equally high strength value in longitudinal and transverse direction.

Preferably, the air shaft wall facing the main cylinder is an air guide plate which, in upstream direction and spaced from the main cylinder T, forms a first throttle point with an opposite wall portion and which, with the peripheral surface of the main cylinder, forms a second throttle point within the range of the fiber doffing zone.

Due to the constriction of the air shaft in a region situated in front of the main cylinder, the fiber doffing zone is a stabilized vacuum range in which the flow speed is homogenized to a high extent .over the total width of the machine. The advanced throttle point is responsible for an immediate automatic pressure compensation over the total machine width thus ensuring a uniform volume flow over the total width downstream of the throttle point.

The air guide plate may be continuously curved to exclude sudden changes of air pressure or air speed in the air shaft.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
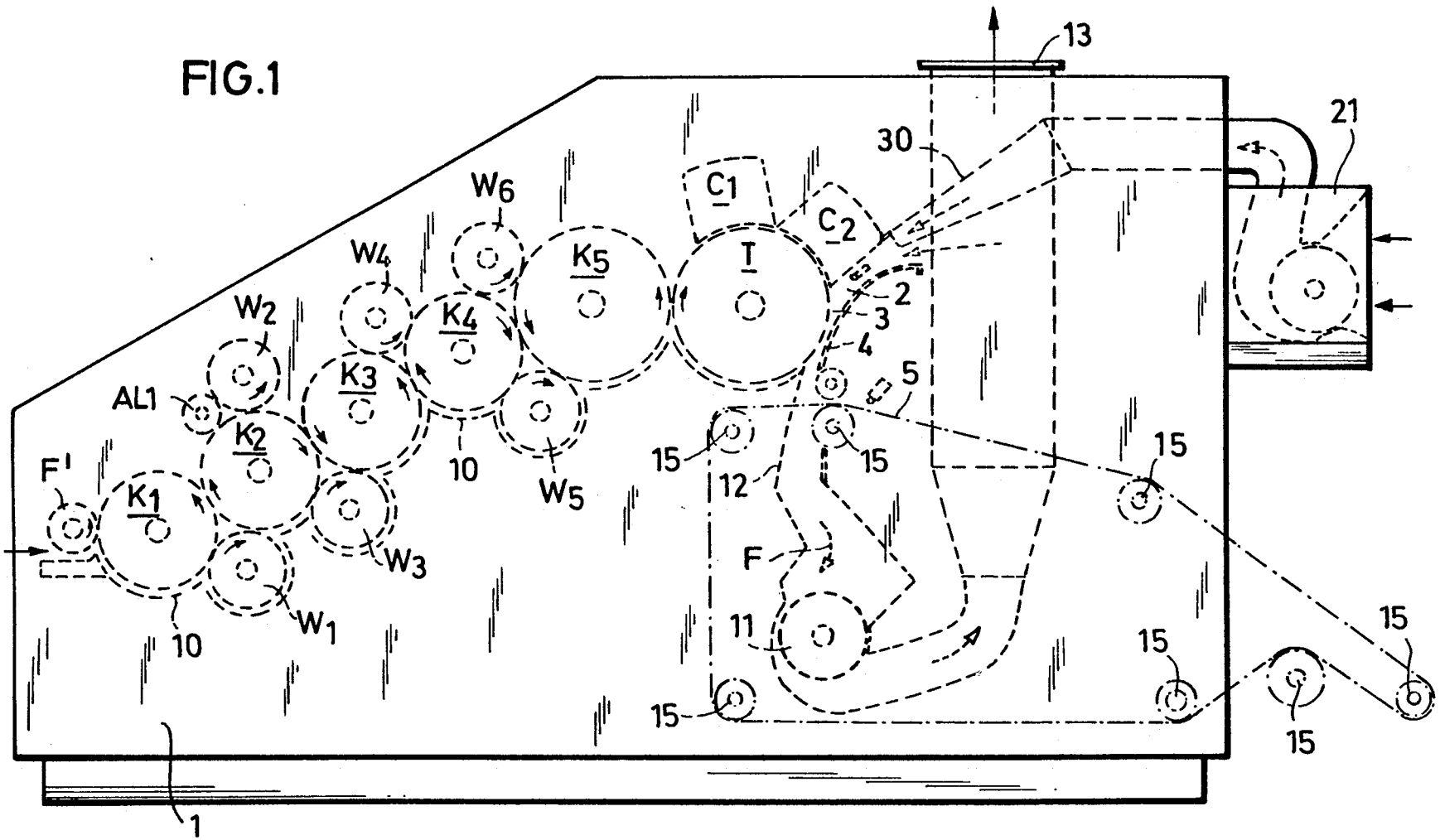
FIG. 1 shows a nonwovens card for producing fibrous webs formed aerodynamically.

In a preferred embodiment the air guide plate comprises a circular cylindrical curvature whose radius substantially corresponds to or is greater than that of the main cylinder. In case of a substantial agreement between the radius of curvature of the main cylinder and of the air guide plate, the cross sectional construction at the second throttle point is symmetric so that another homogenization of the air current is performed at the fiber doffing zone, said second homogenization of the air current being particularly advantageous because the absorbed air current homogenized over the width of the machine after the first throttle point is blended once more with the air current entrained by the main cylinder.

The air guide plate is so adjustable that the gap width of the first and/or of the second throttle point is variable. By means of the adjustable air guide plate, an adaptation to specific production conditions and fiber materials is possible, the gap widths of the two cross sectional constructions being adjustable separately. After all, the pressure conditions within the range of the fiber doffing zone may be influenced by the gap width.

The air flow rate within the area of the fiber doffing zone may substantially correspond to the peripheral speed of the main cylinder. Hence, the speeds of the absorbed air current, of the air current rotating concomitantly with the main cylinder and of the fibers thrown off the main cylinder are equal, thus allowing a blending without turbulences. Preferably, the air rate of the absorbed air is inferior to the peripheral speed of the drum.

According to another preferred embodiment, between the fiber feed means and the main cylinder, there is provided a carding section having a plurality of carding rolls in succession with associated workers, the carding section ensuring a particularly effective opening of fibers so that the only duty still left to the carding elements at the main cylinder pertains to the fine opening thus permitting a considerable homogenization of the opened fibers over the width of the machine.

Another preferred embodiment provides a second fan blowing an additional air current into the upper portion of the air suction funnel.

Due to said increased damming pressure at a throttle point, differences in pressure and flow are compensated more quickly over the total machine width.

Preferably, the additional air current is introduced by the second fan in advance of the first throttle point of the air shaft. By this means, an increase of the damming pressure in advance of the first throttle point is caused by the second fan.

Further, within the range of the first throttle point, an air compression profile may be provided over the total width of the air shaft, said air compression profile increasing the throttle resistance and its effect being similar to that of the damming pressure increase ahead of the throttle point.

The air current compression profile may preferably include a ionization rod adapted to discharge electrostatically the absorbed air current.

The nonwovens card of FIG. 1 comprises a machine frame 1 receiving in the carding section five successively arranged carding rollers K1 to K5 to which six workers W1 to W6 are associated. The spinning material or supply web being fed by the feed roller $F^1$ with feeding trough. At the end of the carding section, the fibrous web present on the last carding roller K5 is taken over by the main cylinder or drum T. For finest opening, drum T is provided with two carding cover segments preferably consisting of cardmaster segments C1 and C2.

Except for the worker W2, the works two corresponding carding rollers. Worker W2 together with roller AL1 forms a worker stripping unit associated to the carding roller K2, it being possible for said worker stripping unit to be associated to carding roller K4. If so, the worker W5 is omitted, while worker W4 is arranged between carding rollers K2 and K3. From carding roller to carding roller, in direction of the operation progress, there is provided an increase of the roller speed together with a systematic gradation of clothing thus obtaining a high carding effect for a progressive fiber isolation.

The rollers of the carding section, the lower workers W1, W3, W5 and the drum may be covered by trough plates 10.

The diameter of the drum roller is about 550 mm. In case of half the speed of the drum, the carding roller K5 preferably has the same diameter while the diameters of carding rollers K1 to K4 may be smaller.

The preferred peripheral speed of the drum ranges between 2.800 to 3.300 m/min. With a drum diameter of 500 mm, this corresponds to a rotational speed of 1.600 to 1.900 rotations per minute.

The extremely fine-opened fibrous web taken from the carding section is disintegrated once more by means of the cardmaster plates. Subsequently, on account of the high centrifugal forces of the drum T, it is thrown behind the last cardmaster segment C2 into an air current, which, subject to the fiber amount, has a flow rate between 20 and 40 m/sec. The air amount required to this effect is about 50 to 100 $m^3$/min per meter of machine width.

The air current is generated in an aerodynamically formed air shaft 2 of a design such as to form an air current without turbulences in the fiber doffing zone 3 behind the last cardmaster segment C2, said air current being adapted to mix free of turbulences with the air current D entrained by and thrown off the drum and with the fibers thrown off the drum.

The individual fibers thrown away are conveyed by air current E and without contacting the chute wall designed as an air guide plate 4 to a perforated conveying belt 5 on which, subject to the adjusted machine parameters, in particular to the air parameters, they are deposited as a random web or as an oriented fibrous web 7 which has a high homogeneity as to fiber distribution and as to card web thickness.

Conducted by a plurality of rollers 15, the perforated conveyer belt 5 continuously rotates, while, within the circulation path of the conveyer belt 5, a cross current fan 11 is arranged which, over the total machine width, at the lower end of air shaft 2, in a suction chute 12, generates a uniform and adjustable vacuum. Immediately behind the fiber take-off point, a vacuum between 10 and 50 mm Ws is formed accordingly. Said cross current fan 11 only needs one-third of the capacity of a conventional sucking means, and it substantially contributes to the fact that a working width of e.g. 3,50 m is possible at all.

The suction chute 12 between conveyer belt 5 and cross current fan 11 extends over the total machine width. The exhaust air flow of the cross current fan 11 is removed through a laterally discharging exhaust air shaft 13 conducted upwardly in vertical direction.

Beneath the conveyer belt 5, the cross current fan 11 generates a suction current F having a specific volume between 50 and 100 $m^3$/(min. m), said volume current F corresponding to the air current E in the lower part of chute 2. Said air current E is composed of air current D entrained by the drum periphery and of the additionally absorbed air current C from the upper portion of the air shaft 2. It should be mentioned that the air current C is composed either only of the air current A absorbed through the inlet opening 2A of the air shaft 2, or of the air current A and of an air current B introduced additionally. In case of need, said additional air current B may be blown by a fan 21 shown in FIG. 1, without increasing the flow rate of the resultant air current E in the area of the fiber doffing zone 3.

Figure 2:
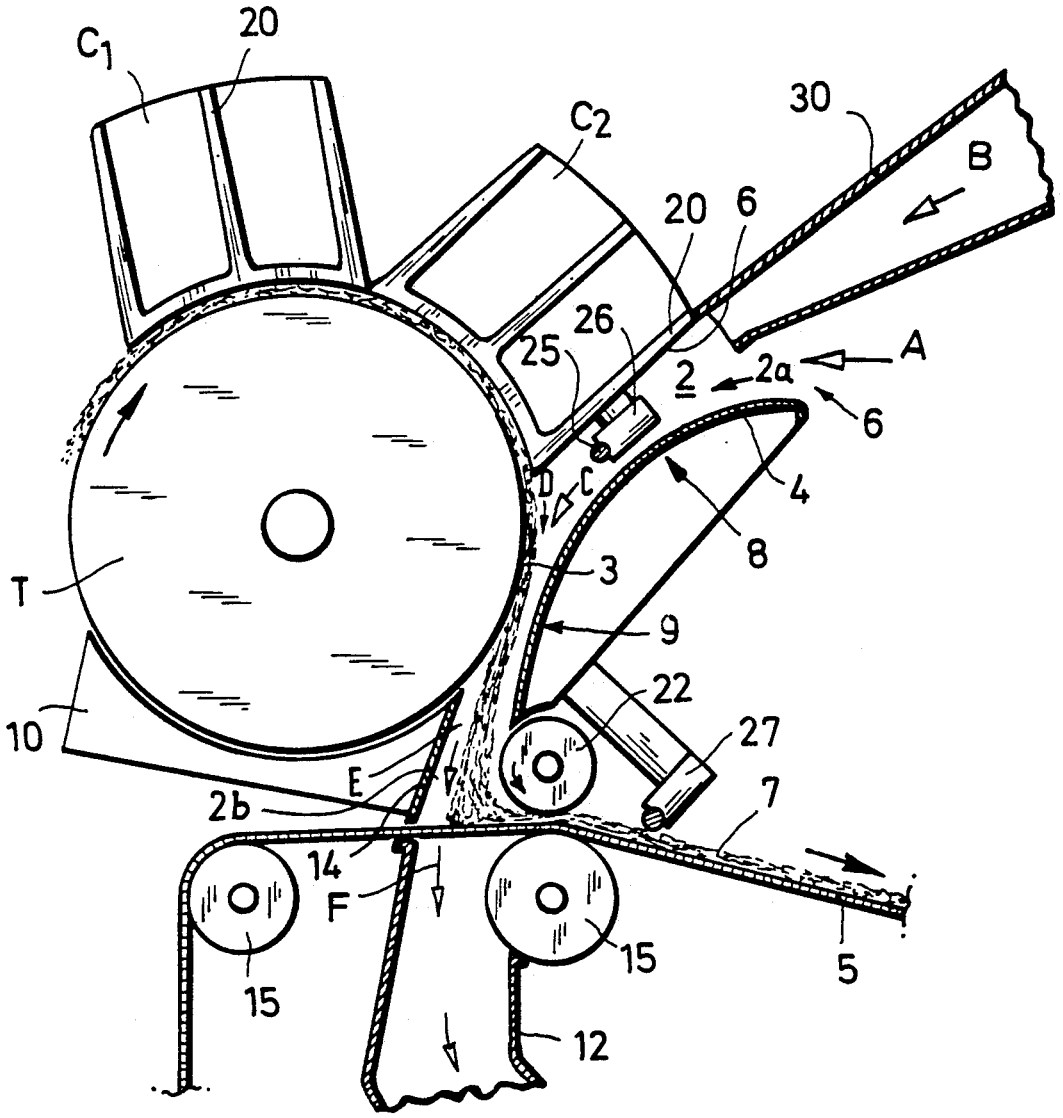
FIG. 2 shows the air shaft extending tangentially to the main cylinder, with laminar air current.

FIG. 2 shows details of the drum T and of the air shaft 2. The web fed to said drum may be supplied via a carding section, such as shown in FIG. 1, or by a feed roller with intake trough in combination with a lickerin. However, the card web aspect of the second solution is less satisfactory.

The cardmaster segments C1 and C2 arranged on drum T are provided with massive ribs 20 to avoid a deflection of the cardmaster segments in case of excessive machine widths. The outermost rib 20 of the cardmaster segment C2 in peripheral direction of the drum simultaneously serves a substantially rectilinear wall portion 6 of air shaft 2. As turned out by tests that, preferably, at the drum-side end of said wall portion 6, no trajectory control plate closing the drum carding section should be provided but, upon leaving the cardmaster segment range, the fibers should be directly thrown into the air current.

The air guide plate 4 extending over the total machine width is so curved that an approximate nozzle shape is imparted to the cross section of the air shaft 2, while, between the wall portion 6 and the air guide plate 4, a constriction in the form of a first throttle point spaced from the drum T is formed, said throttle point 8 causing a homogenization of the air current over the total machine width. The additional air current B is introduced by blowing into a conically convergent blast funnel 30 extending over the total width of air shaft 2. Ahead of the first throttle point, there is formed a damming pressure which also contributed to a homogenization of the air current over the total machine width.

What is important is that the contour of the air guide plate 4 is aerodynamically favorable, i.e. steady, so that air turbulences are excluded even in case of high flow rates.

If a carding section is arranged in accordance with FIG. 1, the cardmaster plates C1 and C2 may be also omitted and replaced by cover segments without any carding function. If so, the wall portion 6 is made of a sheet which, either, as shown in FIG. 2 is substantially rectilinear, or, which, symmetrically to the curved air guide plate 4, is also curved on the opposite side of shaft 2.

The drum-side end of the wall portion 6 of the air shaft 2 ends at a peripheral section of the drum approximately 10 to 15° above the horizontal plane through the drum axis. This point, directly subsequent to the cardmaster segment 2, is the beginning of the fiber doffing zone 3 in which a mixing between air currents D and C and the thrown-off individual fibers is taking place. Thereafter, the air guide plate 4 together with the peripheral drum surface form a second throttle point 9 from which the individual fibers may freely fly without being able to mutually interhook on the short exit path to the conveyer belt 5 and without contacting the air guide plate 4. The fibers deposit on the conveyer belt 5 to form a fibrous web, and by the optional use of a take-off roller 22, they travel on at a take-off speed of 2 m/sec.

The lower part of the air guide plate 4 may be rectilinear and inclined towards the vertical plane through the drum axis. On the opposite side of the air guide plate 4 in the lower shaft section **2*b*, there is provided a plough knife 14 secured to the trough plate 10 and forming the shaft wall confronted with the air guide plate 4 in the lower shaft section 2*b*, said plough knife together with trough 10 being pivotal about the drum axis so that the gap width of the lower shaft area 2*b* is adjustable. The plough knife 14 is adapted to take a position parallel to the lower section of the air guide plate 4 or a position conically diverging from the air guide plate 4**.

Furthermore, the air guide plate 4 may be adjusted horizontally so that the gap widths of the first and of the second throttle points may vary. In addition, the air guide plate 4 may be swivelled so that the gap widths of the individual throttle points are adjustable independently of each other. The gap width at the second throttle point is adjustable between 10 and 40 mm.

In the upper portion **2*a* of the air shaft 2, within the range of the first throttle point 8, there may be provided an air compression profile 25 of an aerodynamically shaped cross section which substantially contributes to a homogenization of the nonwoven formation. At the same time, said air compression profile 25 may be used to receive a ionization means 26** which, at a high voltage of about 7 to 8 kV, electrostatically discharges the absorbed air to prevent fiber agglomerations by electrostatic forces.

A second ionization means 27 may be positioned above the conveyer belt 5 downstream of the take-off roller 22.

While a preferred embodiment of the invention has been described using specific terms, such description is for illustrative purposes only, and it is to be understood that changes and variations may be made without departing from the spirit or scope of the following claims.

What is claimed is:

1. Carding apparatus for forming air laid fibrous webs, comprising:

means for feeding fibers;

a driven main cylinder;

an air-permeable web conveying means receiving a web from said main cylinder;

an air passage substantially tangential to the main cylinder adjacent a fiber doffing zone and extending to said air-permeable web conveying means;

a suction means arranged beneath the web conveying means;

an air suction gap having a substantially nozzle-shaped cross section forming an upper portion of the air passage producing a laminar air stream;

said main cylinder exerting a centrifugal force, said centrifugal force throwing the fibers in the fiber doffing zone into said laminar air stream generated in said air passage and conveying said fibers to the web conveying means for deposit as a continuous fiber web; and whereby carding apparatus especially suitable for manufacturing nonwovens is provided.

2. The structure set forth in claim 1 wherein a wall of the air passage opposite the main cylinder is an air guide plate spaced from the main cylinder, a first throttle point with an opposed wall portion, and a second throttle point including a peripheral surface of the main cylinder adjacent said fiber doffing zone said first and said second throttle points providing means adjustable for varying a fiber orientation of said fiber web.

3. The structure set forth in claim 2 wherein the air guide plate wall, opposite said main cylinder, is continuously convexly curved.

4. The structure set forth in claim 3 wherein the curvature of the air guide plate is a circular cylindrical curvature having a radius at least equal to that of the main cylinder radius.

5. The structure set forth in claim 3 wherein the air guide plate extends adjacent a horizontal plane extending through the main cylinder axis.

6. The structure set forth in claim 2 wherein the air guide plate is adjustable so that a gap width of at least one of the throttle points may be varied.

7. The structure set forth in claim 1 wherein the air guide plate is rectilinear in a lower portion adjacent said upper portion of the air passage shaft.

8. The structure set forth in claim 6 wherein the gap width of the second throttle point adjacent the fiber doffing zone is adjustable within the range of 10 mm and 40 mm.

9. The structure set forth in claim 1 wherein an air compression profile is provided over a total width of the air passage and adjacent the first throttle point.

10. The structure set forth in claim 1 including a plough knife pivotal about the drum axis rests against a periphery of the main cylinder downstream of the fiber doffing zone.

11. The structure set forth in claim 1 wherein a maximum flow rate of air adjacent the fiber doffing zone is no greater than a peripheral speed of the main cylinder.

12. The structure set forth in claim 1 wherein a carding section comprising, in successive order, a plurality of carding rollers with associated workers is between the fiber feed means and the main cylinder.

13. The structure set forth in claim 1 wherein carding elements are arranged on a periphery of the main cylinder between said means for feeding fiber and said fiber doffing zone.

14. The structure set forth in claim 13 wherein the carding elements of the main cylinder are carding cover segments of metallic card clothing.

15. The structure set forth in claim 14 wherein the fiber doffing zone extends adjacent the carding cover segments.

16. The structure set forth in claim 1 wherein the suction means consists of a cross current fan positioned directly beneath the conveying means and being adjustable as to its suction capacity.

17. The structure set forth in claim 1 wherein a second fan is provided in the upper portion of the air passage to supply an additional air current.

18. The structure set forth in claim 17 wherein the second fan supplies the additional air current prior to the first throttle point of the air passage.

19. The structure set forth in claim 1 wherein an ionization rod is provided in an upper portion of the air passage entirely thereacross.

20. The structure set forth in claim 19 wherein the ionization rod is carried by an air compression profile.

21. The structure set forth in claim 1 wherein the fibrous web deposited on the web conveying means, is in communication with a second ionization rod extending entirely across and above the fibrous web.

22. The method of air laying a continuous fibrous web comprising the steps of:

applying fibers onto a drum rotating at a speed sufficient to dislodge said fibers therefrom;

throwing adjacent a fiber doffing zone, said fibers from the drum into an air current;

transporting the fibers in the air current to an air-permeable web conveying means and separating the fibers from the air current on the web conveying means; and generating a laminar air current adjacent the fiber doffing zone.

23. The method set forth in claim 22 wherein an absorbed air current is compressed at least once prior the entry of the fibers into the air current and at least once with the entry of the fibers into the air current.

24. The method set forth in claim 22 wherein a vacuum between 10 and 50 mm is adjustably maintained adjacent the fiber doffing zone.

25. The method set forth in claim 22 wherein a maximum flow velocity of the air current in the fiber doffing zone corresponds to a peripheral speed of the drum.

26. The method set forth in claim 22 wherein a flow velocity of the air current in the fiber doffing zone is adjustable between 20 and 40 m/s.

27. The method set forth in claim 22 wherein the air current is generated by suction, and, in addition, another air current is generated prior to the entry of the fibers into a resultant air current in order to increase damming pressure prior to compression of said resultant air current.

28. The method set forth in claim 22 wherein an air current between 40 and 120 $m^3$/ (min.m) is generated.

29. Carding apparatus comprising:

a fiber feed means;

a main cylinder rotating at a high speed; and a carding section provided between the fiber feed means and the main cylinder;

said main cylinder exerting a centrifugal force, said centrifugal force throwing the fibers from the cylinder into a fiber doffing area;

within the area of a horizontal plane through the main cylinder axis and on the side of the main cylinder opposite the carding section, an air passage is tangentially arranged entirely across the main cylinder;

an air suction gap having a nozzle-shaped cross section defined by an upper portion of said air passage;

an air permeable web conveying means beneath the air passage;

a suction means beneath the web conveying means generating a laminar suction current in the air passage;

by the air current, the fibers thrown off the main cylinder are moved to the web conveying means to be deposited as a fibrous web.

* * * * *